US005638040A

United States Patent [19]

Craft, III

[11] Patent Number: 5,638,040

[45] Date of Patent: Jun. 10, 1997

[54] MAGNETIC WIGGLER

[75] Inventor: Benjamin C. Craft, III, Baton Rouge, La.

[73] Assignee: Board of Supervisors of Louisiana State University and Agricultural and Mechanical College, Baton Rouge, La.

[21] Appl. No.: 746,074

[22] Filed: Nov. 6, 1996

[51] Int. Cl.[6] ..... H01F 7/00

[52] U.S. Cl. ..... 335/210; 315/5.35; 315/503

[58] Field of Search ..... 335/210, 213; 315/501, 503, 5.35; 372/2

[56] References Cited

PUBLICATIONS

A. Grudiev et al., "Superconducting 7.5 Tesla Wiggler for PLS," *Nuclear Instruments and Methods,* vol. A359, pp. 101–106 (1995).

L. Welbourne, "A Second Superconducting Wiggler Magnet for the Daresbury SRS," *Synchrotron Radiation News,* vol. 5, No. 5, pp. 15–17 (1992).

U. Bandow et al., "Calculation of the Dynamic Aperture in the ANKA Storage Ring with a High–Field Wavelength Shifter," *Fifth European Particle Accelerator Conference* (Barcelona, Jun. 10–14, 1996).

Budker Institute of Nuclear Physics, "Proposal of the Superconducting Wiggler—CAMD" (May 17, 1996) (unpublished).

*Primary Examiner*—Lincoln Donovan
*Assistant Examiner*—Raymond M. Barrera
*Attorney, Agent, or Firm*—John H. Runnels

[57] ABSTRACT

A magnetic wiggler is disclosed that allows the magnetic field to be readily adjusted to alter the characteristic energy of emitted synchrotron radiation. However, the source point and direction of the emitted x-ray spectrum do not change. Thus x-ray energies may easily and quickly be adjusted without dismantling, repositioning, and reassembling associated apparatus.

5 Claims, 4 Drawing Sheets

MAGNETIC WIGGLER

This invention pertains to a magnetic wiggler, particularly to a superconducting wiggler that is adjustable to conveniently and rapidly tune the characteristic energy of the x-ray spectrum emitted by electrons in a synchrotron, with minimal resulting downtime.

Charged particles emit electromagnetic radiation when accelerated. Electrons accelerated at high energy around the circuit of a synchrotron emit x-rays having a characteristic spectrum of energies. The energy spectrum is a function of the magnetic field, the electron energy, and the electron current. This spectrum is characterized by a "critical energy" $\epsilon_{[keV]}=0.665\ B\ E^2$, where B is the scalar magnitude of the magnetic field (in Tesla), and E is the energy of an electron in the synchrotron in (GeV). (Some x-rays in the spectrum will have energies higher than $\epsilon$, and some lower. The total spectrum scales with $\epsilon$ in a well-defined and characteristic manner.)

Typical magnetic fields B in the "bending" regions of a synchrotron are on the order of 1.2–1.8 Tesla. By placing an "insertion device" or "wiggler" in a straight section of a synchrotron, the magnetic field B over a short region can be manipulated to as high as 7 Tesla or even higher, increasing the critical energy $\epsilon$. Prior wigglers have, for example, used an insertion device having a magnetic field B such as that shown in FIG. 1(*a*), which produces a deflection in the electron path such as that shown in FIG. 1(*b*). In both FIGS. 1(*a*) and 1(*b*), the horizontal axis denotes position in the straight section of a synchrotron, in m. The vertical axis in FIG. 1(*a*) denotes the magnetic field, in Tesla. The vertical axis in FIG. 1(*b*) denotes the orbit deviation of electrons, in m. Note that the source point for x-rays (approximate location indicated by * in all figures) lies off the axis of the (undiverted) electron path. Not only is the source point off-axis, but when the magnitude of the magnetic field B is manipulated to produce different x-ray energies, the position of the source point changes. Even a small change in the position of the source point can require lengthy dismantling, repositioning, and reassembly of precision apparatus designed to use the synchrotron-emitted x-rays in a beam line off the synchrotron.

A. Grudiev et al., "Superconducting 7.5 Tesla Wiggler for PLS," *Nuclear Instruments and Methods,* vol. A359, pp. 101–106 (1995) discloses a superconducting wiggler with a maximum field of 7.5 Tesla. As the "beam deviation" curve of figure 8 of this paper shows, the source point for x-rays lay off the axis of the (undiverted) electron path. Furthermore, the position of the source point would change as the peak magnetic field changed.

See also L. Welbourne, "A Second Superconducting Wiggler Magnet for the Daresbury SRS," *Synchrotron Radiation News,* vol. 5, no. 5, pp. 15–17 (1992); and U. Bandow et al., "Calculation of the Dynamic Aperture in the ANKA Storage Ring with a High-Field Wavelength Shifter," *Fifth European Particle Accelerator Conference* (Barcelona, Jun. 10–14, 1996).

There is an unfilled need for a synchrotron wiggler that can adjust the magnetic field and therefore the critical energy of an emitted x-ray spectrum, without changing the position of the source point.

A novel synchrotron wiggler has been discovered. The novel wiggler allows the magnetic field to be readily adjusted to alter the characteristic energy of the emitted x-ray spectrum. However, the source point and direction of the emitted x-ray spectrum do not change. Thus the x-ray energies may easily and quickly be adjusted without dismantling, repositioning, and reassembling associated apparatus designed to use the emitted x-rays.

In one embodiment of this invention, the wiggler produces a magnetic field B such as that shown in FIG. 2(*a*), which produces a deflection in the electron path such as that shown in FIG. 2(*b*). In FIGS. 2(*a*) through 2(*c*), the horizontal axis denotes position in the straight section of a synchrotron, in cm. The vertical axis in FIG. 2(*a*) denotes the magnetic field, in Tesla. The vertical axis in FIG. 2(*b*) denotes the orbit deviation of electrons, in cm. The vertical axis in FIG. 2(*c*) depicts the trajectory angle deviation, in mrad, of the electron path caused by the magnetic field of FIG. 2(*a*). Note in FIG. 2(*b*) that the source point * for x-rays lies directly on the axis of the (undiverted) electron path. The strength of the magnetic field at the midpoint of the wiggler may be altered to produce different x-ray energies by adjusting the magnitude of the central "spike" in the magnetic field, without changing the position of the source point, or the direction of x-rays emitted at the source point.

BRIEF DESCRIPTION OF THE DRAWINGS

FIG. 1(*b*) depicts the deflection in electron path caused by the magnetic field of FIG. 1(*a*).

FIG. 2(*b*) depicts the deflection in electron path caused by the magnetic field of FIG. 2(*a*). FIG. 2(*c*) depicts the trajectory angle deviation of the electron path caused by the magnetic field of FIG. 2(*a*).

A stationary source point (i.e., one that is stationary at the position of maximum magnetic field strength, and that has a stationary direction of x-ray synchrotron emission, even as B changes) results if the following three conditions are satisfied:

$$\int_{s_1}^{s_2} B_y(s)ds = 0; \tag{1}$$

$$\int_{s_1}^{s_2}\int_{s_1}^{s'} B_y(s)dsds' = 0; \text{ and} \tag{2}$$

(3) the magnitude of B at the source point may be varied without substantially changing the values of $k_1$ or of $k_2$; where s and s' each denote position along the axis of the storage ring, $s_1$ and $s_2$ denote the effective boundaries of the magnetic field B of the wiggler along that axis, $B_y(s)$ denotes the scalar magnitude of the magnetic field B perpendicular to that axis, s* denotes the longitudinal position of the source point, and:

$$k_1 = \int_{s_1}^{s^*} B_y(s)ds$$

-continued $$k_2=\int_{s_1}^{s^*}\int_{s_1}^{s'} B_y(s)dsds'$$

Condition (1) is equivalent to saying that the direction of travel of the electron beam before the wiggler section is parallel to the direction of travel of the electron beam after the wiggler section. Condition (2) is equivalent to saying that there is no net deflection of the electron beam as it passes through the wiggler. Condition (3) is equivalent to saying that the transverse position of the source point and the direction of x-ray radiation at the source point do not change substantially. Preferably, the position of the source point does not vary by a distance of more than 50% of the width of the electron beam at the source point; more preferably, by not more than 20%; and most preferably, by not more than 10%. Preferably, the direction of x-ray radiation does not change by more than 50% of the natural divergence of the x-ray radiation at the source point (including divergence due to inherent divergence of electron trajectories at the source point); more preferably, by not more than 20%; most preferably by not more than 10%. The magnitude of B at the source point may vary from a lower limit of about 0 Tesla; preferably from a lower limit of about 2 Tesla; to an upper limit of at least about 4 Tesla; more preferably to an upper limit of at least about 6 Tesla; and most preferably to an upper limit of at least about 7.5 Tesla.

Figure 1A:
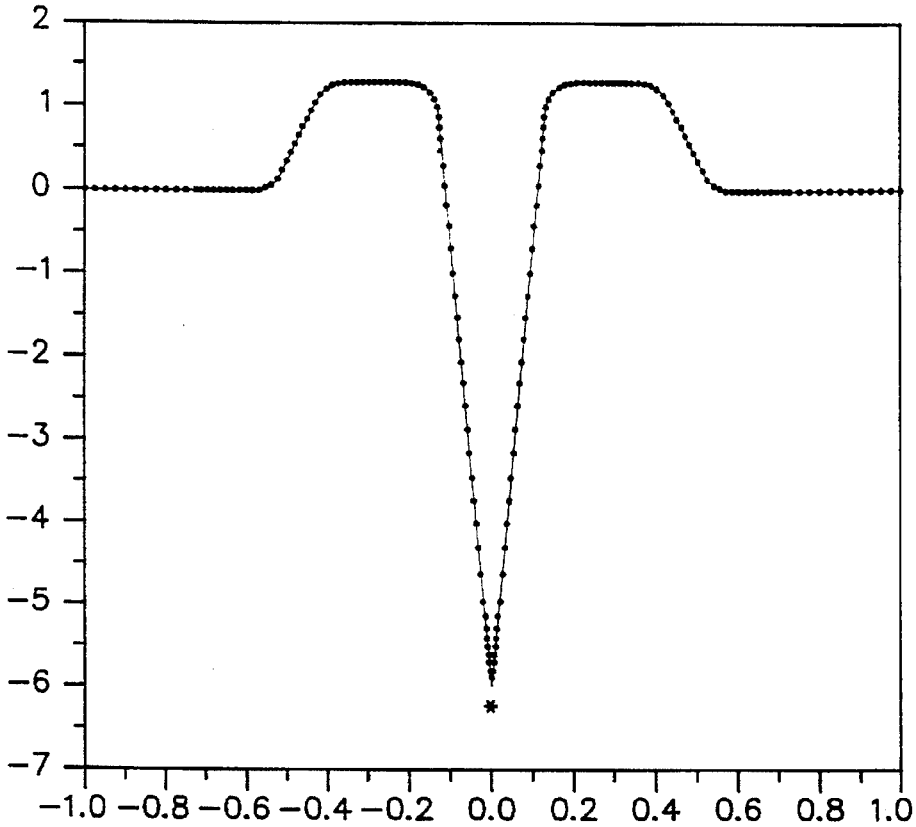
FIG. 1(*a*) depicts the magnetic field of a prior superconducting wiggler.
Figure 1B:
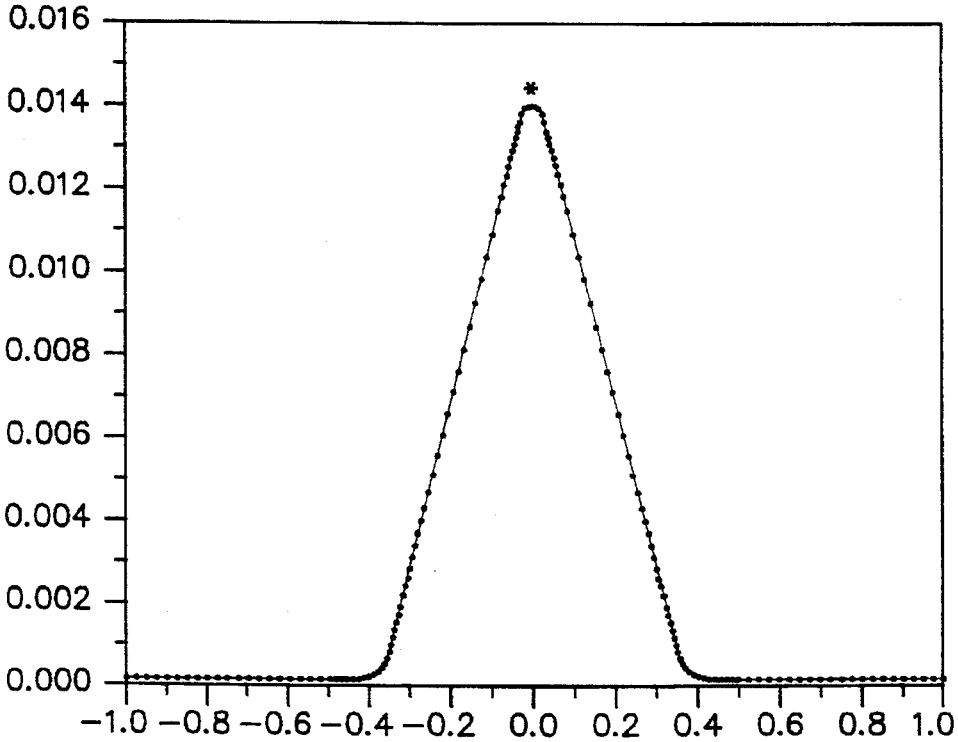
Figure 2A:
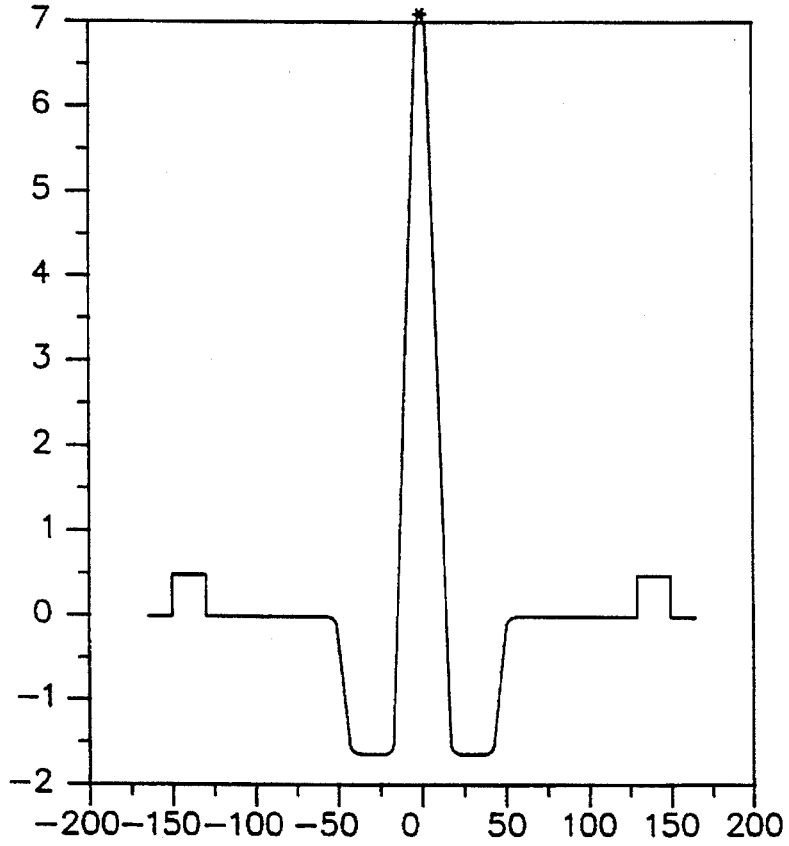
FIG. 2(*a*) depicts the magnetic field of one embodiment of a wiggler in accordance with the present invention.
Figure 2B:
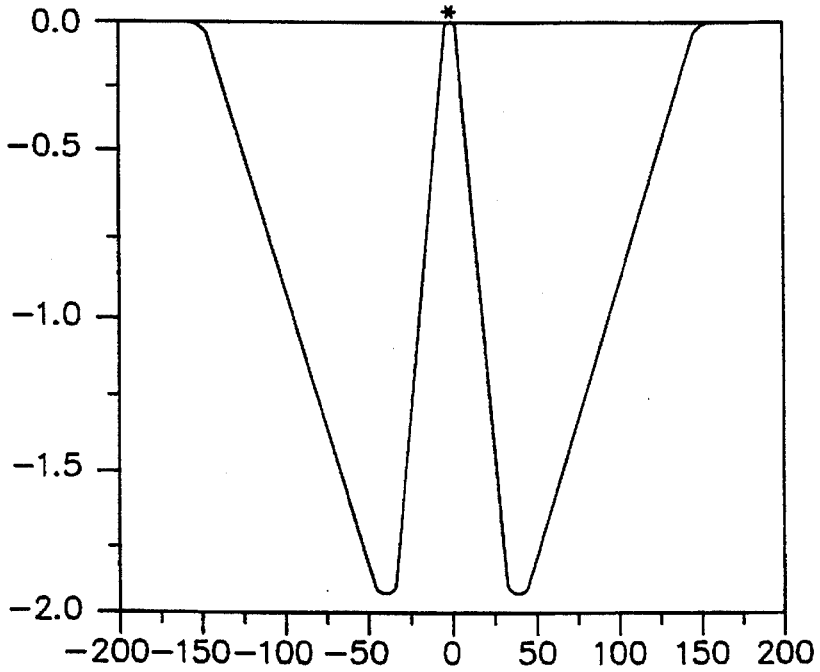
Figure 2C:
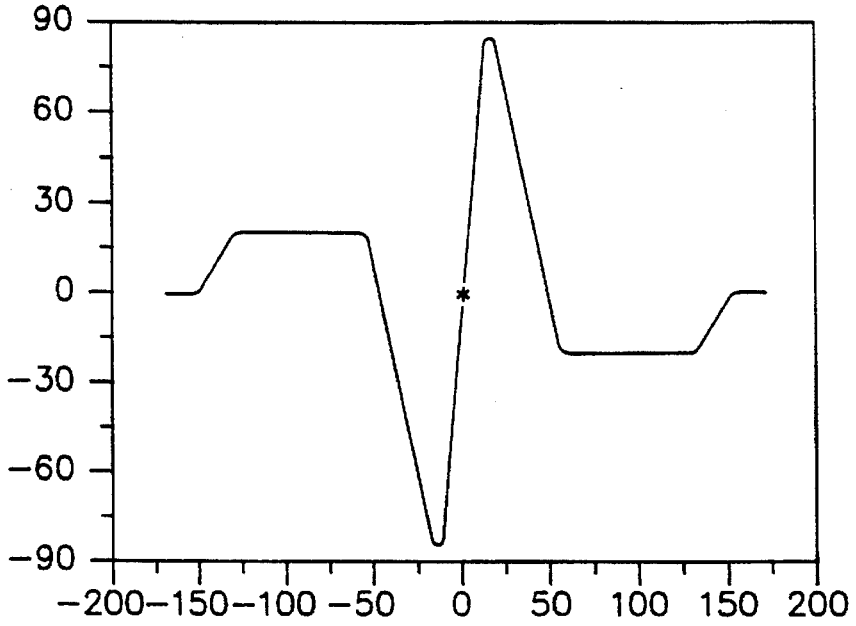

As shown in the embodiment illustrated in FIGS. 2(*a*) and 4, one way to satisfy these conditions is with a series of magnets having opposite polarity. The strength of the strongest magnetic field at the midpoint of the wiggler may be altered to produce different x-ray energies by simultaneously adjusting the fields so that conditions (1), (2), and (3) continue to be satisfied. The magnetic field of the central "spike" (produced by a superconducting magnet) may be 7 Tesla or even higher, allowing the energy of the x-ray spectrum to be readily manipulated without the necessity of repositioning accessory beam-line apparatus as the energy of the x-rays is tuned. Other magnetic components of the wiggler may use normal conducting magnets, or superconducting magnets. The magnitude of the extremes of the magnetic field on axis away from the "middle" of the wiggler preferably should not exceed about 1.7 Tesla. The wiggler preferably incorporates suitable "trim" windings to make minor adjustments to satisfy the requirements of a stationary source point.

In a preferred embodiment, the wiggler satisfies the following conditions: (1) The wiggler magnetic field is symmetric about its horizontal mid-plane; (2) the wiggler magnetic field is symmetric about the vertical mid-plane parallel to the bore of the wiggler; (3) the wiggler magnetic field is symmetric about the vertical mid-plane perpendicular to the bore; and (4) the wiggler is designed such that at all pertinent levels of wiggler excitation the electron trajectory passes through the "middle" of the wiggler, and the electron trajectory is, at that point, parallel to the "axis" of the wiggler.

In the preferred embodiment depicted in FIG. 2(*a*), the magnet is a five-pole magnet whose poles satisfy the following conditions:

(a) the first and fifth poles are aligned parallel to one another; are the same distance from the source point; and have contributions $I_1$ and $I_5$ to the integral of $B_y$ that are equal to one another in magnitude and sign:

$$I_1=\int_{first\ pole} B_y(s)ds=I_5=\int_{fifth\ pole} B_y(s)ds$$

(b) the second and fourth poles are aligned parallel to one another, and are aligned opposite to the first and fifth poles; the second and fourth poles are each the same distance from the source point; and have contributions $I_2$ and $I_4$ to the integral of $B_y$ that are equal to one another in magnitude and sign; and $I_2$ and $I_4$ are double in magnitude and opposite in sign as compared to $I_1$:

$$I_2=\int_{second\ pole} B_y(s)ds=I_4=\int_{fourth\ pole} B_y(s)ds=-2I_1$$

(c) the third pole is centered at the source point; is symmetric about the source point; and has a contribution $I_3$ to the integral of $B_y$ that is double in magnitude and equal in sign to $I_1$:

$$I_3=\int_{third\ pole} B_y(s)ds=2I_1;\ \text{and}$$

(d) the magnitude of the magnetic field B produced by the third pole is variable in order to alter the critical energy of synchrotron radiation.

Figure 3:
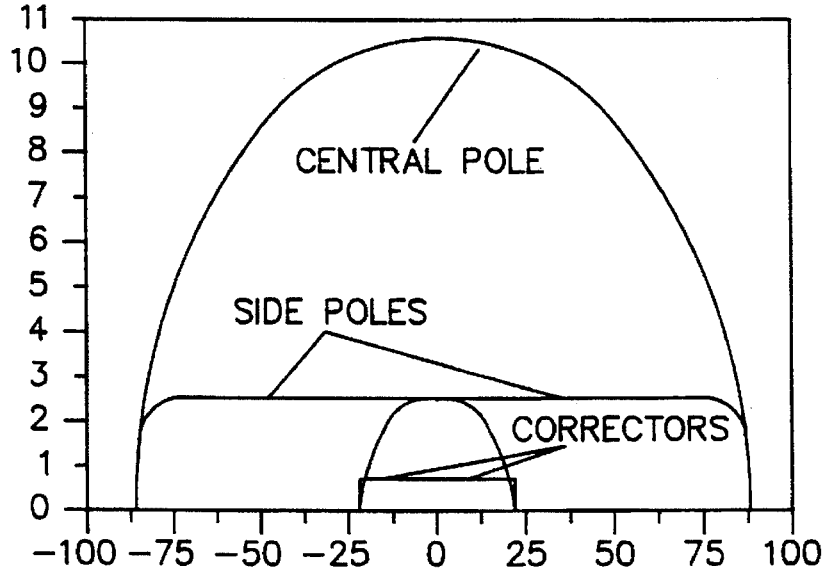
FIG. 3 depicts the critical x-ray energy in keV as a function of horizontal angle resulting from the various components of the magnetic field depicted in FIG. 2(*a*), assuming an electron energy E of 1.5 GeV.

FIG. 3 depicts the critical x-ray energy in keV as a function of horizontal angle, in mrad, resulting from the various components of the magnetic field depicted in FIG. 2(*a*), assuming an electron energy E of 1.5 GeV.

The prototype embodiment of the novel superconducting wiggler depicted in FIGS. 2(*a*) and 4 is being constructed and will be placed into service at the Louisiana State University J. Bennett Johnston, Sr. Center for Advanced Microstructures and Devices ("CAMD"). CAMD has an electron storage ring with a four-fold, super-symmetric CHASMAN-GREEN magnetic lattice. Electrons are injected into the CAMD storage ring at 180 MeV. Once routine operating current has accumulated in the ring, the beam energy is increased to 1.3 to 1.5 GeV. The superconducting wiggler will be placed in the center of one of four "non-dispersive" straight sections of the storage ring, each of which is about 3.2 meters in length. Each straight section contains four quadrupole magnets and is bounded on either end by 45 degree bending magnets. Additional technical information concerning the prototype embodiment may be found in the following (unpublished) response to CAMD's request for bids to construct the prototype: Budker Institute of Nuclear Physics, "Proposal of the Superconducting Wiggler—CAMD" (May 17, 1996).

Figure 4:
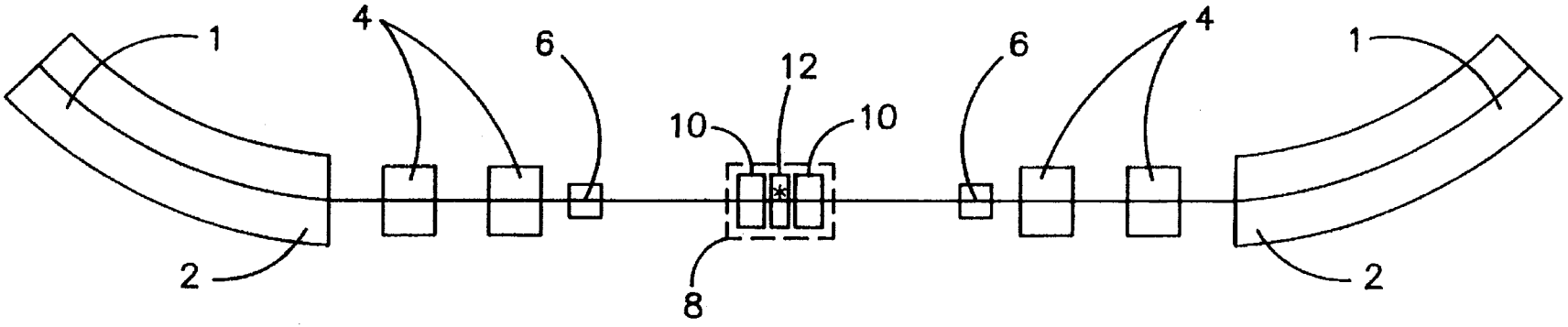
FIG. 4 depicts schematically the insertion of one embodiment of the present invention into a straight section of an electron storage ring.

In the embodiment depicted in FIG. 4, the undistorted electron trajectory is depicted as path 1, and bending magnets 2 and quadrupole magnets 4 are previously existing elements of the CAMD electron storage ring. The five-pole wiggler is divided into a superconducting portion, and a conducting portion. The two magnets 6 may be conducting magnets, reducing the expense of cooling those components of the wiggler. Magnets 6 are sometimes referred to as "corrector" magnets. With corrector magnets 6 being normally conducting magnets, only the three-pole "core" 8 of the wiggler, comprising two magnets 10 and "spike" magnet 12, need be superconducting. The magnetic field, and consequently the x-ray spectrum, are adjusted by adjusting the strength of the "spike" magnet 12, consistent with the conditions previously identified.

The complete disclosures of all references cited in this specification are hereby incorporated by reference. In the event of an otherwise irreconcilable conflict, however, the present specification shall control.

I claim:

1. A wiggler for tuning the energy of synchrotron radiation emitted by electrons traversing the wiggler, said wiggler comprising a magnet that produces a field B satisfying the following conditions:

(a) $\int_{s_1}^{s_2} B_y(s)ds$ is substantially zero;

(b) $\int_{s_1}^{s_2}\int_{s_1}^{s'} B_y(s)\,ds\,ds'$ is substantially zero; and (c) the magnitude of B at the source point may be varied without substantially changing the values of $k_1$ or of $k_2$, wherein the source point is the point where the magnitude of B is greatest along the path of electrons traversing said wiggler;

wherein:

(d) the trajectory of electrons passes through substantially the same source point as B changes;

(e) the direction of the electron trajectory at the source point does not change substantially as B changes; and (f) s and s' each denote position along a straight line traversing said wiggler; $s_1$ and $s_2$ denote the effective boundaries of the magnetic field B of the wiggler along that line; s* denotes the position of the source point along that line; and $B_y(s)$ denotes the scalar magnitude of the magnetic field B perpendicular to that line;

(g) $k_1=\int_{s_1}^{s^*} B_y(s)ds$; and (h) $k_2=\int_{s_1}^{s^*}\int_{s_1}^{s'} B_y(s)\,ds\,ds'$;

whereby:

(i) electrons traversing said wiggler emit synchrotron x-ray radiation whose critical energy varies as B varies, with the synchrotron radiation emitted from substantially the same source point in substantially the same direction as B varies.

2. A wiggler as recited in claim 1, wherein said magnet is a five-pole magnet comprising a first pole, a second pole, a third pole, a fourth pole, and a fifth pole, wherein:

(a) said first and fifth poles are aligned parallel to one another; are the same distance from the source point; and have contributions $I_1$ and $I_5$ to the integral of $B_y$ that are substantially equal to one another in magnitude and sign:

$$I_1=\int_{first\ pole} B_y(s)ds=I_5=\int_{fifth\ pole} B_y(s)ds$$

(b) said second and fourth poles are aligned parallel to one another, and are aligned opposite to said first and fifth poles; said second and fourth poles are each the same distance from the source point; and have contributions $I_2$ and $I_4$ to the integral of $B_y$ that are equal to one another in magnitude and sign; and $I_2$ and $I_4$ are substantially double in magnitude and opposite in sign as compared to $I_1$:

$$I_2=\int_{second\ pole} B_y(s)ds=I_4=\int_{fourth\ pole} B_y(s)ds=-2I_1$$

(c) said third pole is centered at the source point; is symmetric about the source point; and has contribution $I_3$ to the integral of $B_y$ that is substantially double in magnitude and equal in sign to $I_1$:

$$I_3=\int_{third\ pole} B_y(s)ds=2I_1;\ \text{and}$$

(d) the magnitude of the magnetic field B produced by the third pole is variable in order to alter the critical energy of synchrotron radiation.

3. A wiggler as recited in claim 2, wherein each of said second, third, and fourth poles is produced by a superconducting magnet.

4. A wiggler as recited in claim 2, wherein said third pole is produced by a superconducting magnet, and wherein the maximum magnetic field produced by said third pole is at least about 7 Tesla.

5. A wiggler as recited in claim 1, wherein:

(a) the magnetic field B is substantially symmetric about each of two mutually perpendicular planes, wherein the intersection of these two planes is substantially collinear with the direction of the electron trajectory in the synchrotron both before and after said wiggler; and (b) the magnetic field B is substantially symmetric about a plane normal to the line defined by this intersection, wherein the intersection of this plane and this line is the source point of x-rays emitted by electrons traversing said wiggler.

* * * * *